US006481034B2

(12) United States Patent
Elsener et al.

(10) Patent No.: US 6,481,034 B2
(45) **Date of Patent: *Nov. 19, 2002**

(54) MULTIPLE FUNCTION TOOL

(75) Inventors: Carl S. Elsener, Ibach (CH); Eduard A. Elsener, Gutschweg (CH); Albert F. Rohrer, Schwyz (CH); Walter X. Rohrer, Schwyz (CH); Franco Giarritta, Rickenbach (CH)

(73) Assignee: Swiss Army Brands, Inc., Shelton, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/796,817

(22) Filed: Mar. 1, 2001

(65) Prior Publication Data

US 2001/0005913 A1 Jul. 5, 2001

Related U.S. Application Data

(63) Continuation of application No. 09/437,790, filed on Nov. 10, 1999, now Pat. No. 6,243,901, which is a continuation of application No. 09/874,959, filed on Jun. 13, 1997, now Pat. No. 6,009,582, which is a continuation of application No. 08/739,707, filed on Oct. 29, 1996, now abandoned.

(51) Int. Cl.[7] ..... B26B 11/00
(52) U.S. Cl. ..... 7/118; 7/128; 7/129; 30/161
(58) Field of Search ..... 7/118, 128, 129; 81/438, 439, 440; 30/161

(56) References Cited

U.S. PATENT DOCUMENTS

| | | | |
|---|---|---|---|
| 400,480 | A | 4/1889 | Peters |
| 445,972 | A | 2/1891 | Caldwell |
| 589,392 | A | 8/1897 | Kolar |
| 592,766 | A | 11/1897 | Effinger et al. |
| 645,563 | A | 3/1900 | Heath |
| 1,359,760 | A | 11/1920 | Smith |
| 1,614,949 | A | 1/1927 | Finley |
| 1,647,405 | A | 11/1927 | Giesen |
| 2,446,022 | A | 7/1948 | Peterson |
| 2,575,652 | A | 11/1951 | Bovee |
| 3,798,687 | A | 3/1974 | Stevens |
| 3,868,774 | A | 3/1975 | Miori |

(List continued on next page.)

FOREIGN PATENT DOCUMENTS

| | | |
|---|---|---|
| CH | 277412 | 11/1951 |
| DE | 30788 | 8/1984 |
| DE | 9103496.5 | 6/1991 |
| EP | 0 513 937 A2 | 4/1987 |
| SU | 1002145 | 3/1983 |
| WO | WO 97/19787 | 11/1996 |

*Primary Examiner*—James G. Smith
(74) *Attorney, Agent, or Firm*—Pennie & Edmonds LLP

(57) ABSTRACT

A compound, multiple function, foldable tool having first and second handles, a tool head with pivotable jaw members, and a plurality of additional tools. The tool head are stored within first channels on first sides of the handles, and the additional tools are stored within second channels on second sides of the handles opposite the first sides. Thus, when the tool head is used, the additional tools do not interfere with gripping of the handles during use of the tool head. Moreover, because of the position of the additional tools, these tools are easily accessible while the tool head is in the storage position. The compound tool may also include a ratchet and an adapter and coupler that fit on the ratchet or at least one of the additional tools so that even further tools may be fit on the compound tool. An easy to read full length, straight edge ruler may optionally be provided on the top and bottom surfaces of the handles. Preferably, an individual spring is provided for each tool to prevent further pivoting of the selected tool away from the storage channels once the tool is extended into a working position. A spring lock mechanism may also be provided to prevent the undesired return of an extended tool into the storage position until the lock is released.

18 Claims, 14 Drawing Sheets

U.S. PATENT DOCUMENTS

| | | | | | |
|---|---|---|---|---|---|
| 4,037,276 | A | | 7/1977 | Brinker | |
| 4,078,272 | A | | 3/1978 | Mahon, III | |
| 4,122,569 | A | | 10/1978 | Hitchcock | |
| 4,157,616 | A | | 6/1979 | Lundquvist | |
| 4,187,607 | A | | 2/1980 | Simuro et al. | |
| 4,573,268 | A | | 3/1986 | Call | |
| 4,644,831 | A | * | 2/1987 | Yang | 81/439 X |
| 4,819,289 | A | | 4/1989 | Gibbs | |
| 4,837,932 | A | * | 6/1989 | Elsener | 30/161 |
| 4,854,045 | A | | 8/1989 | Schaub | |
| 4,856,132 | A | | 8/1989 | Burns et al. | |
| 4,888,869 | A | | 12/1989 | Leatherman | |
| 4,891,881 | A | | 1/1990 | Mills | |
| 4,918,775 | A | | 4/1990 | Leu | |
| 4,942,637 | A | | 7/1990 | Yeang-Yai | |
| 4,953,248 | A | | 9/1990 | Trombetta | |
| 4,960,016 | A | | 10/1990 | Seals | |
| 4,961,239 | A | | 10/1990 | Boyd, Sr. et al. | |
| D321,637 | S | | 11/1991 | Chan | |
| D321,821 | S | | 11/1991 | Luchak | |
| D332,384 | S | | 1/1993 | Dague | |
| D336,415 | S | | 6/1993 | Cheng | |
| D338,386 | S | | 8/1993 | Frazer | |
| D345,088 | S | | 3/1994 | Otero | |
| D350,271 | S | | 9/1994 | Landy et al. | |
| D356,020 | S | | 3/1995 | Costa | |
| 5,416,940 | A | * | 5/1995 | Bandera | 7/118 |
| D360,815 | S | | 8/1995 | Padden | |
| D382,182 | S | | 8/1997 | Seber et al. | |
| 5,697,114 | A | * | 12/1997 | McIntosh et al. | 7/129 |
| 5,781,950 | A | * | 7/1998 | Swinden et al. | 7/128 |
| 5,809,600 | A | * | 9/1998 | Cachot | 7/128 |
| 5,916,277 | A | * | 6/1999 | Dallas | 7/128 |
| 6,088,861 | A | * | 7/2000 | Sessions et al. | 7/128 |
| 6,145,144 | A | * | 11/2000 | Pochlmann et al. | 7/128 |
| 6,170,104 | B1 | * | 1/2001 | Seber et al. | 7/128 |

* cited by examiner

MULTIPLE FUNCTION TOOL

CROSS-REFERENCE TO RELATED APPLICATIONS

The present application is a continuation of U.S. patent application Ser. No. 09/437,790, filed Nov. 10, 1999, now U.S. Pat. No. 6,243,901, which is a continuation of U.S. patent application Ser. No. 09/874,959, filed Jun. 13, 1997, now U.S. Pat. No. 6,009,582, which is a continuation of U.S. patent application Ser. No. 08/739,707, filed Oct. 29, 1996, now abandoned.

BACKGROUND OF THE INVENTION

1. Field of the Invention

The present invention relates to a multiple function, compound tool. More particularly, the present invention relates to a combination tool having a tool head with jaw members foldable into channels in the handles and other tools pivotable from a position within other channels of the handles to a position that provides optimum usability of the selected tool.

2. Discussion of the Related Art

Compound, multiple function tools having foldable handles and at least one tool with jaws foldable into the handles are known in the art. Typically, the pliers, or other tool having a pivotable jaw, have a pivot axis and tangs extending from the pivot axis in a direction opposite from the jaw. The tangs are pivotally coupled to the handles. Prior art combination tools have shown jaws that are pivotable about their tangs, either about an axis parallel to the pivot axis of the jaws, or an axis perpendicular to the jaws' pivot axis. Prior art combination tools have also shown jaws that are slidable along the handles of the tool to retract into a channel within the handles.

Multi-function, compact tools typically also include a variety of other tools that may be pivoted into and out of a channel within the handle of the tool for selective use. However, multi-function tools that include a tool having jaw members, such as pliers, typically do not permit access to the remaining tools without opening the handles to also extend the jaw members. Thus, access of a tool other than the pliers often requires more than the single step of extending the desired tool. Moreover, many of such selectable tools are not in an optimum using position when extended out of their respective handles. The selected tool (screwdrivers, in particular) is often in an awkward using position and is generally not aligned to have the greatest amount of centerline force transmitted from the user's hand and arm to the tool. Cutting tools generally are positioned so that a barrier is created by the handles such that the entire length of the sharp edge is not readily usable, Typically, such a barrier is created by having the sharp edge face between the handles and thus spaced from the sides of the tool where the object to be cut, sliced, sawed, etc., is positioned.

Another disadvantage with pivoting of certain models of such tools into and out of their respective channels for use is that once a tool has been extended and locked in place (for those tools that have locks), typically another tool must be extended at least half way to permit the first tool to be replaced into the storage position within its respective channel.

Although combination tools provide a variety of different tools, the user is generally limited in the number of different tools that are available from a given combination tool. For instance, generally only one size of a given tool is provided.

Additionally, certain tools, such as ratchets, generally are not provided in combination tools.

SUMMARY OF THE INVENTION

It is therefore an object of the present invention to provide a multiple unction, compound, compact tool having at least one tool with jaw members retractable into the handle of the tools, and a variety of other tools pivotable into and out of channels within the handles while the jaw members remain in a stored position, retracted within the handles. Likewise, when the jaw members are extended into a usable position, it is an object of the present invention to have the remaining tools out of the way so that comfortable gripping of the handles during jaw member use may be achieved.

It is a related object of the present invention to provide a foldable tool having jaw members easily retractable into the handles of the tool.

It is a further object of the present invention to provide a multiple function tool having a variety of tools extendible, from a retracted position within the handles of the tool, to an optimum position for use such that the full working length of the tool is available and conveniently located, and the axes of the rotating tools are substantially aligned with the centerline of the handles of the tool so that force is substantially directly transmitted along the centerline from the user's hand and arm to the tool.

It is yet another object of the present invention to provide a multiple function tool that permits the tools to be interchangeable, or at least modifiable for different uses or sizes, and also provides tools and features that are not typically provided in compound tools, such as a mechanical reversible ratchet.

It is yet another object of the invention to provide a spring mechanism that permits pivoting of individual tools between a storage position and a working position without affecting adjacent tools. Preferably, the spring mechanism also permits individual locking of the tools in either a straight position or a working position.

These and other objects of the present invention are accomplished in accordance with the principles of the present invention by providing a compact, foldable, multiple function tool having a tool with jaw members retractable into a first storage area of the handles of a tool, and a plurality of different tools retractable into a second storage area of the foldable handles. The tool with the jaw members preferably is a set of pliers having a jaw pivot axis and tangs extending from the jaw pivot axis away from the jaw members. The handles are pivotable along an axis through the tangs substantially parallel to the jaw pivot axis. The jaw members have a working surface formed by the opposing faces of the jaw members, and an outside surface facing away from the working surface. The handles have a working surface, substantially aligned with the outside surface of the jaw members, which surface is gripped during use of the jaw members when the handles are unfolded. The jaw members are stored within channels in these working surfaces of the handles, the outside surfaces of the jaw members being nested within the channels. The handles also include a second surface facing the same side as the working surface of the jaw members, which therefore form an inner surface when the handles are extended to use the jaw members, but an outer grip surface when the handles are folded to make the tool compact, and comfortable to grip.

Another channel is provided in each handle of the tool opposite the channel in which the jaw members are stored, and a variety of other tools may be stored within these additional channels. The other tools are accessible and extendible for use even when the jaw members are still in their retracted, stored position. Thus, the handles may be in a folded position when these other tools are used, so that the handles, together, form a single handle for these other tools. These additional tools are pivotable along a pivot axis substantially parallel to the pivot axis of the jaw members and the tangs, but preferably are connected to an end of the handles opposite the connection point of the jaw members. The shank of each of the tools is preferably designed such that the working area of the tool is in an optimum working position. Thus, at least some of the tools that require rotation are preferably substantially aligned with the central longitudinal axis of the folded handles that form the gripping area of the tool and also are preferably longer than prior art tools and the other tools of the multi-tool. Likewise, cutting tools are preferably designed such that the cutting area is at the most accessible position for cutting, slicing, sawing. etc., an object. Additionally, the handles may be provided with full-length (i.e. 1 inch) rulers that are disposed adjacent to straight free edges.

The multiple function tool of the present invention preferably includes modular components that are positionable and various ones of the pivotable tools to permit the tools that are integral to the compound tool to be modified for other uses. Preferably, an adapter is provided that may be fit on the heads of the tools that are integral to the compound tool. Additional tools may then be positioned on the adapter and used with the compound tool. Additionally, a mechanical reversible ratchet is provided in which a variety of such additional tools may be fit for 90° to the handle socket and tip applications and rotations for clockwise or counterclockwise rotations.

A further feature of the tool of the present invention, is the provision of an individual spring for each tool pivotally connected to the handles. The spring locks the individual tool in its working position by preventing further pivoting of the tool away from its storage position. Furthermore, the individual springs permit repositioning of the tools in the storage position without affecting the position of adjacent tools. A spring lock may be provided to provide an additional lock for the tools to prevent the tools from moving back into the storage position when in the working position. Only when the spring lock is moved may the tool be replaced into the storage position.

These and other features and advantages of the present invention will be readily apparent from the following detailed description of the invention taken in conjunction with the accompanying drawings wherein like reference characters represent like elements, the scope of the invention being set out in the appended claims.

DETAILED DESCRIPTION OF THE INVENTION

Figure 1:
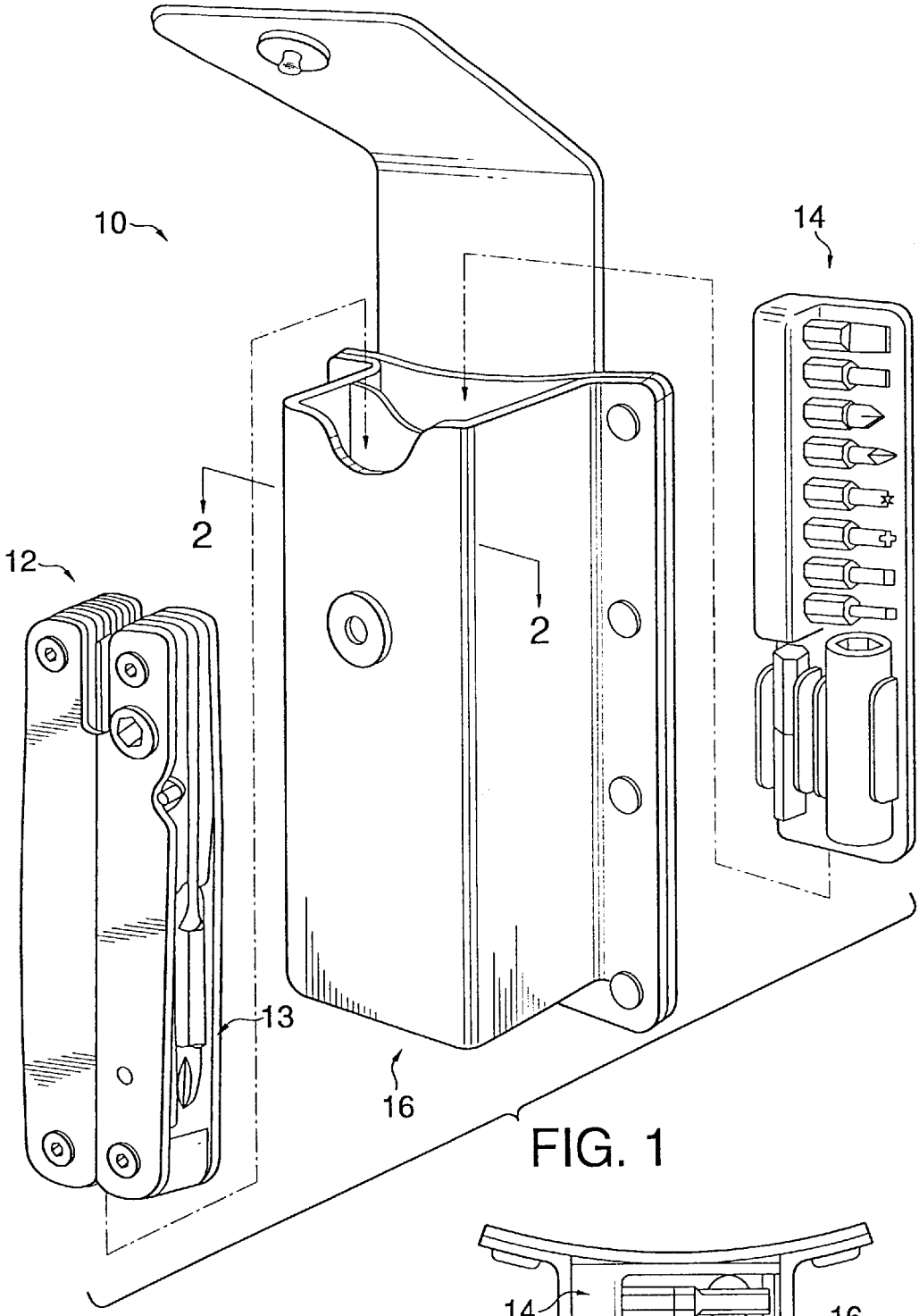
FIG. 1 is a perspective view of a tool set having a compact multiple function tool and a set of adapters and additional heads for use with the multiple function tool, the tool and the adapter and tool heads being positionable within a case in accordance with the principles of the present invention.
Figure 2:
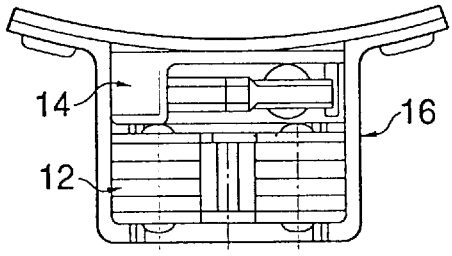
FIG. 2 is a cross-sectional view along line 2—2 of FIG. 1, showing the multiple function tool, adapter, and additional heads in place within the case.

A multiple function tool set 10 formed in accordance with the principles of the present invention is shown in FIG. 1. Tool set 10 includes a compact, foldable, multiple function tool, or "multi-tool" 12, an adapter set 14, and a carrying case 16. Multi-tool 12 and adapter set 14 fit within case 16, as shown in FIG. 2.

Figure 3:
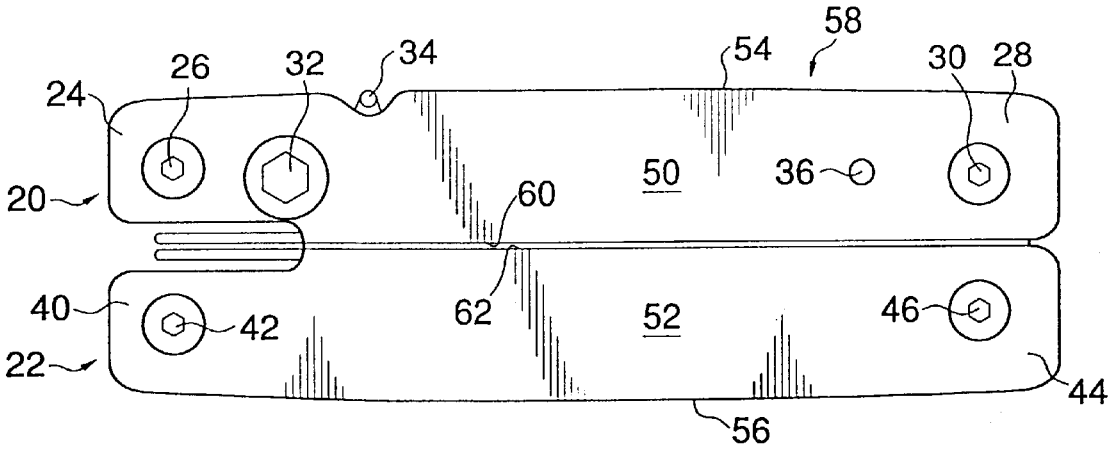
FIG. 3 is a top elevational view of a compact multiple function tool formed in accordance with the principles of the present invention.

Multi-tool 12, shown in the top elevation view in FIG. 3, has a first handle 20 and a second handle 22. First handle 20 has a first, proximal end 24 having a proximal pivot axis 26, and a second, distal end 28 having a distal pivot axis 30. Optionally, first handle 20 also includes a ratchet 32 with ratchet control knob 34 and an additional pivot axis 36, as will be described in greater detail below. The longitudinal axis of first handle 20 may be defined as substantially parallel to a line through proximal pivot axis 26 and distal pivot axis 30. Second handle 22 likewise has a first, proximal end 40 having a first, proximal pivot axis 42, and a second, distal end 44 having a second, distal pivot axis 46. The longitudinal axis of second handle 22 may be defined as substantially parallel to a line through proximal pivot axis 42 and distal pivot axis 46. The longitudinal axis of the handles, together, is equidistant from and substantially parallel to the longitudinal axes of the individual handles. Pivot axes 26, 30, 42, and 46 preferably extend from the top surfaces 50, 52 of handles 20, 22, respectively, to the respective bottom surfaces 51, 53. Each handle 20, 22 further includes a respective exterior first sides 54, 56, forming exterior sides of the handles when multi-tool 12 is in the folded configuration (See FIGS. 3 and 4). The top surfaces 50, 52, the bottom surfaces 51, 53 (FIGS. 10 and 11), and the exterior sides 54, 56 form a gripping surface 58 for the multi-tool 12 when in the folded configuration shown in FIG. 3. As can be seen in FIGS. 1, 10, 11, 17 and 18, first sides 54, 56 are substantially open to allow access to a plurality of tools 13 nested within the handles. Although first sides 54, 56 may be slightly bowed outwardly, as shown in FIG. 3, to provide a comfortable grip, if a ruler is provided on top surfaces 50, 52 and/or bottom surfaces 51, 53 as in the embodiment of FIGS. 19–21 (described in further detail below), first sides 54, 56 are most preferably straight edges. First and second handles 20, 22 further include respective second sides 60, 62 that face each other when multi-tool 12 is in the folded configuration and thus may be considered interior sides as shown in FIG. 3. Second sides 60, 62 have a sufficiently smooth closed surface to form a uniform gripping surface 59 together with the top surfaces 50, 52 and the bottom surfaces 51, 53 when in the unfolded configuration (see FIG. 7). As may be understood from a review of FIGS. 4, 7, and 10–12, the multiple tools of multi-tool 12 are nested within and extracted from either the first sides 54, 56 or the second sides 60, 62 of the handles.

Multi-tool 12 includes a tool head 64, such as a set of pliers, having pivotable jaw members 66 and 68 pivotable along jaw pivot 70. Tool head 64 is nested in channels along second sides 60, 62 that form interior sides of the handles 20, 22 when in the folded configuration such that tool head 64 is substantially hidden from view in the folded configuration shown, for example, in FIGS. 3 and 4.

Jaw member 66 preferably includes a tang 72 pivotally connected to second handle 22 along distal pivot axis 46. Jaw member 68 likewise preferably has a tang 74 pivotally connected to first handle 20 along distal pivot axis 30. Preferably distal pivot axes 30 and 46 are substantially parallel to jaw pivot 70 such that jaw members 66, 68 pivot with respect to handles 20, 22 along an axis substantially parallel to their pivot axis 70. As may be seen in FIG. 4, jaw members 66, 68 of tool head 64 are nested along second sides 60, 62 of handles 20, 22. As may be seen in FIG. 5, jaw member 68 has first and second gripping surfaces 76, 77 provided with a plurality of fine teeth, preferably extending parallel to each other and laterally across jaw member 68. In the preferred embodiment, tool head 64 is a set of pliers, and gripping surface 76 is at the distal-most, pointed section of jaw 68. Preferably, as may be seen, for example, in FIG. 4, each jaw member 66, 68 also includes a sharp edge 78, edges 78 together forming a wire cutter 79. It will be understood that jaw 66 is substantially similar to jaw 68.

Figure 4:
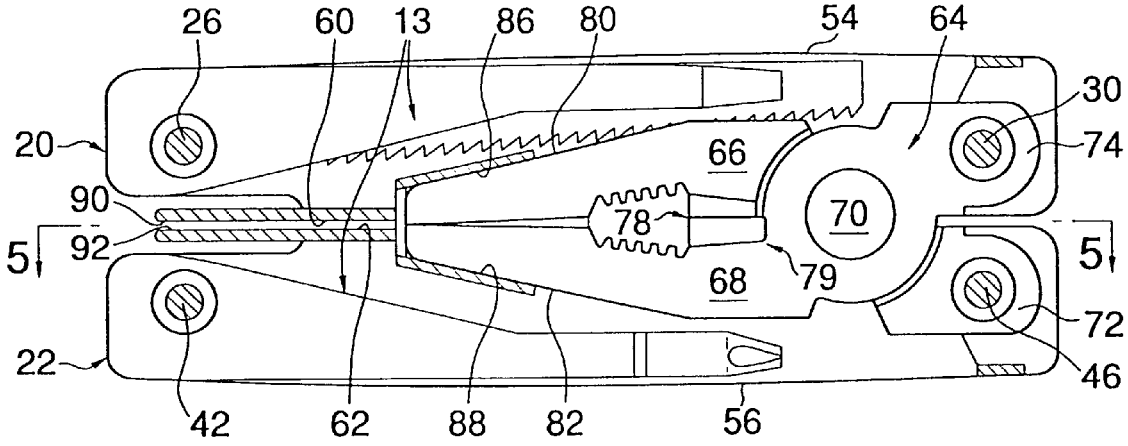
FIG. 4 is a cross-sectional view of the tool of FIG. 3, showing a variety of tools nested within the handles of the compact tool.
Figure 5:
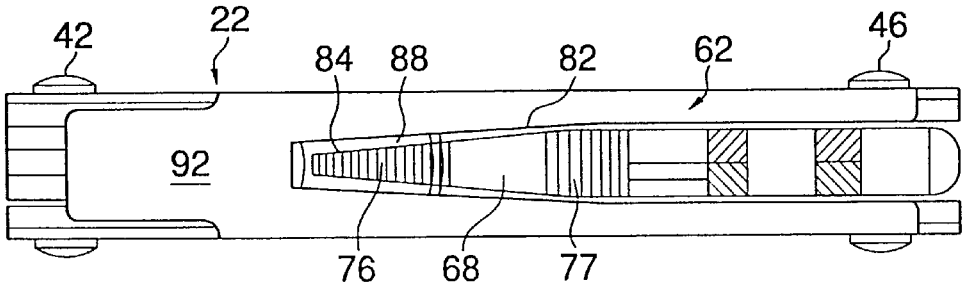
FIG. 5 is a cross-sectional view along line 5—5 of FIG. 4 showing a plan view of the interior side of the tool of the present invention.
Figure 6:
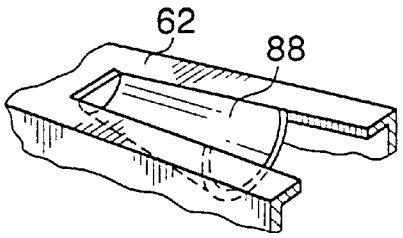
FIG. 6 is an isolated perspective view of an inclined tool jaw pocket formed in a handle of the tool of the present invention.
Figure 7:
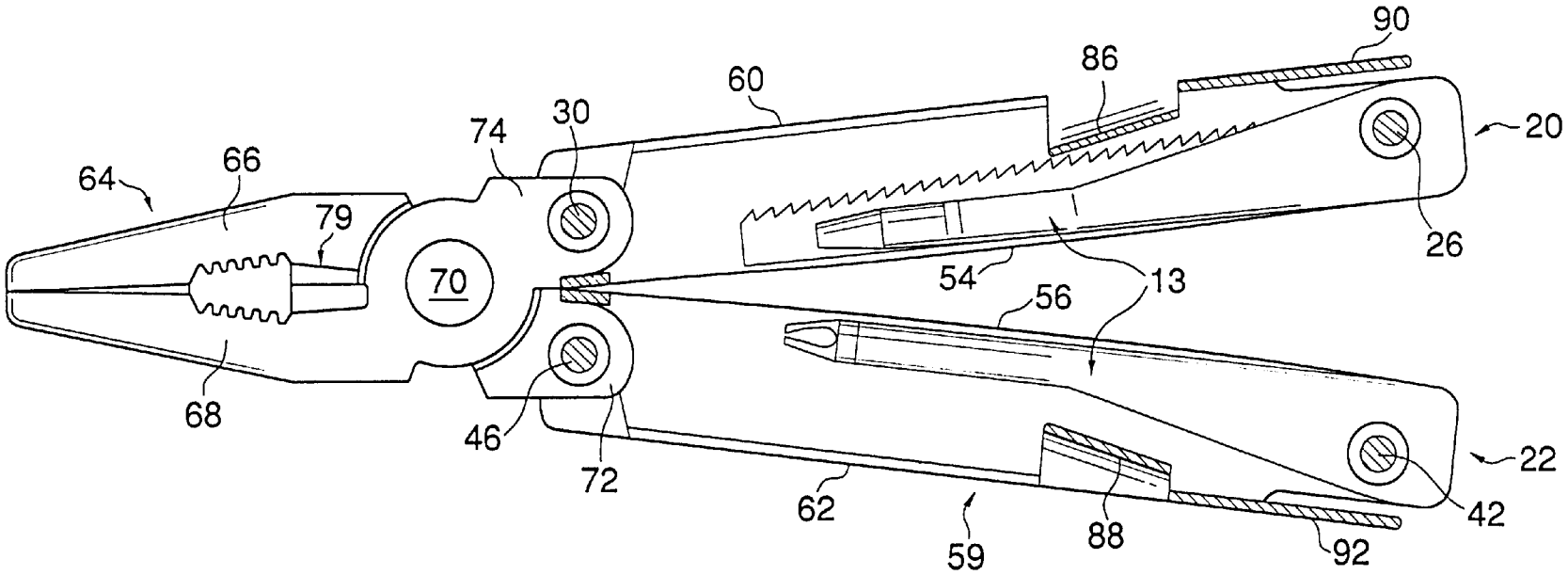
FIG. 7 is an elevational view of the tool of the present invention shown in an unfolded configuration with a tool having a jaw member being in an extended position.
Figure 8:
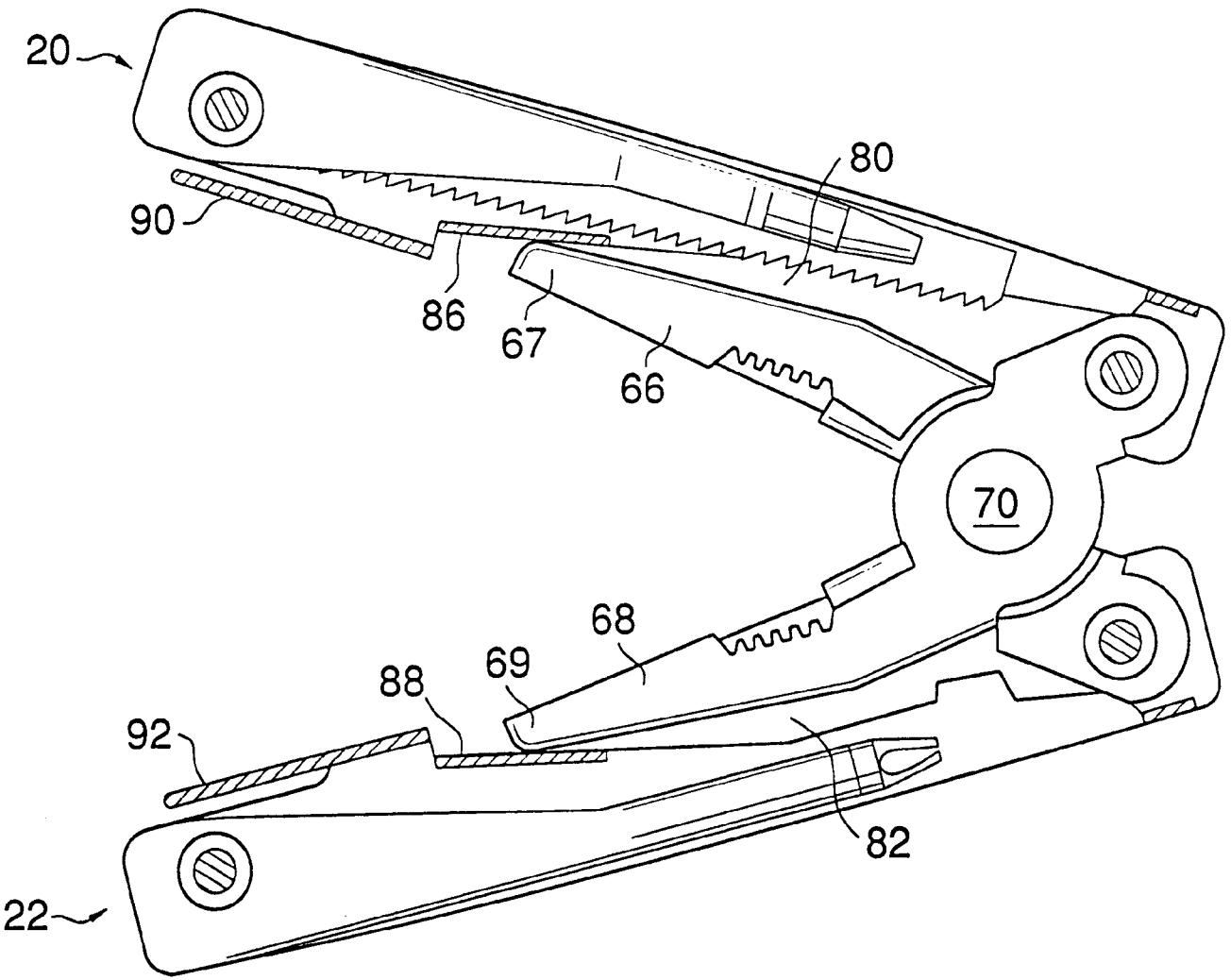
FIGS. 8 and 9 are sequential elevational views of the tool of the present invention being folded into a compact configuration.
Figure 9:
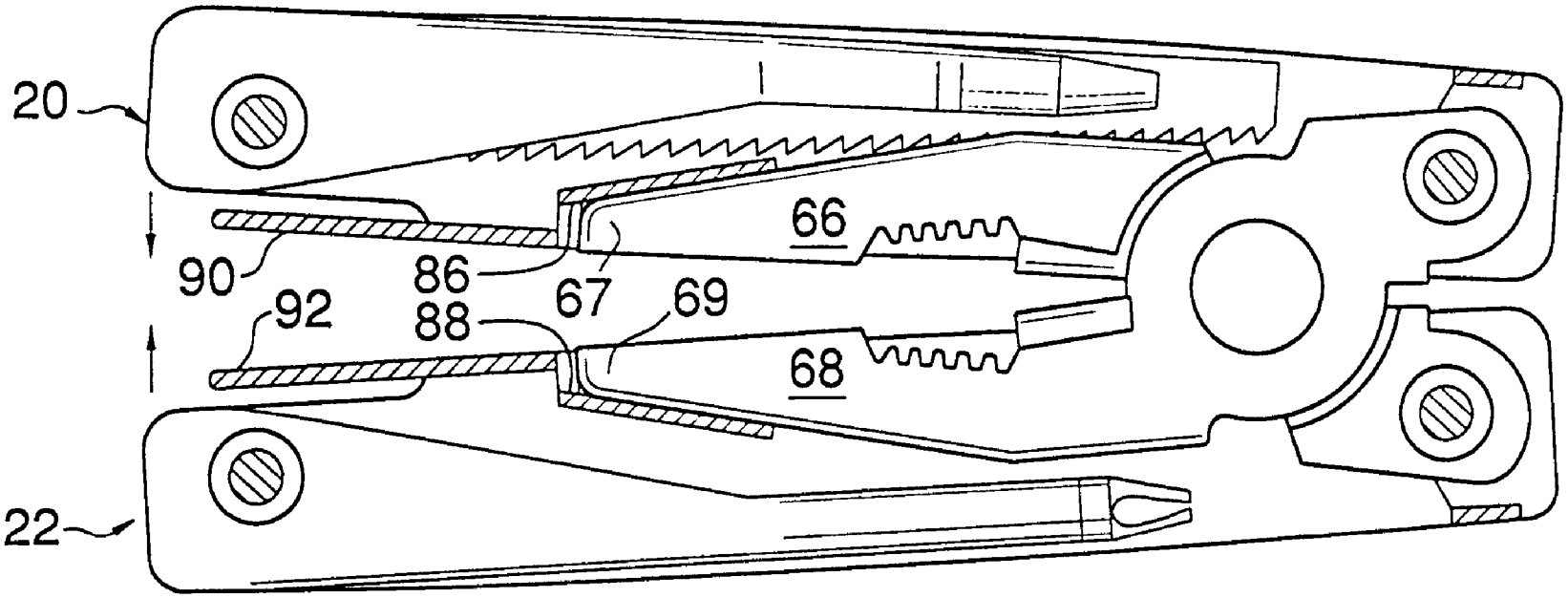

Jaw members 66 and 68 are nested in respective tool head channels 80, 82 in the second sides 60, 62 of respective first and second handles 20, 22 as may be seen in FIGS. 4 and 5. The distal, pointed end 67, 69 of each jaw member 66, 68 is preferably nested within the specially configured inclined pockets or inclined planes 86, 88, as may be seen in FIGS. 4 and 5. Pocket 88 is shown in more detail in FIG. 6. Each pocket 86, 88 is inclined to facilitate folding and sliding of tool head 64 within the interior surfaces of handles 20, 22, as shown in FIGS. 8 and 9, upon pivoting the handles about their respective distal axes 30, 46 to fold multi-tool 12 from an unfolded configuration (as shown in FIG. 7) into its compact, folded configuration (shown, for example, in FIGS. 3 and 4). As may be seen in FIGS. 8 and 9 (which sequentially show the folding of multi-tool 12 such that tool head 64 is nested within handles 20, 22) the distal ends 67, 69 of jaw members 66, 68 are the first parts of tool head 64 to enter tool head channels 80, 82. Distal ends 67, 69 first contact inclined pockets 86, 88, as shown in FIG. 8. The inclination of pockets 86, 88 facilitates smooth sliding and positioning of jaw members 66, 68 within pockets 86, 88, as shown in FIG. 9, and hence smooth positioning of tool head 64 within tool head channels 80, 82 for storage. Preferably, a self-lubricating material is used at pockets 86, 88 to further facilitate sliding of jaw members 66, 68 therealong. Inclined jaw pockets 86, 88 may be formed from the tool head channels material or by the separate spring and/or locking devices.

When first and second handles 20, 22 are pivoted about their respective distal axes 30, 46 to open multi-tool 12, tool head 64 is extended from its retracted position into a usable position, such as shown in FIG. 7. Second sides 60 and 62 are thereby exposed to face outwardly, away from each other, and first sides 54, 56 are thereby positioned at the inside of the tool, facing each other in this configuration for use of the tool head 64. As may be seen in FIGS. 4, 8 and 9, and more clearly understood from reviewing FIG. 7, second sides 60, 62 of first and second handles 20, 22 further include grip surfaces 90, 92 to facilitate gripping of handles 20, 22 in utilizing tool head 64. Accordingly, even though handles 20 and 22 have open channels 80, 82 in which jaw members 66, 68 are respectively nested, smooth surfaces 90, 92 are provided so that a user may comfortably grip handles 20 and 22 during use of tool head 64. Surfaces 90, 92 may be bowed or textured or coated or otherwise formed to increase user comfort during gripping.

As may be seen, for example, in FIGS. 4 and 7, additional tools 13 are nested within handles 20, 22 adjacent first sides 54, 56, respectively, which are exterior sides when handles 20, 22 are folded (as in FIG. 3) but which face each other when tool head 64 is in a usable position, as in FIG. 7. Thus, when multi-tool 12 is in the folded configuration of FIG. 3, tools 13 are easily accessible because they are accessed through exterior first sides 54, 56 of handles 20, 22. However, when tool head 64 is used, tools 13 are not easily accessible and therefore do not interfere with the gripping of handles 20 and 22 during use of tool head 64.

Figure 10:
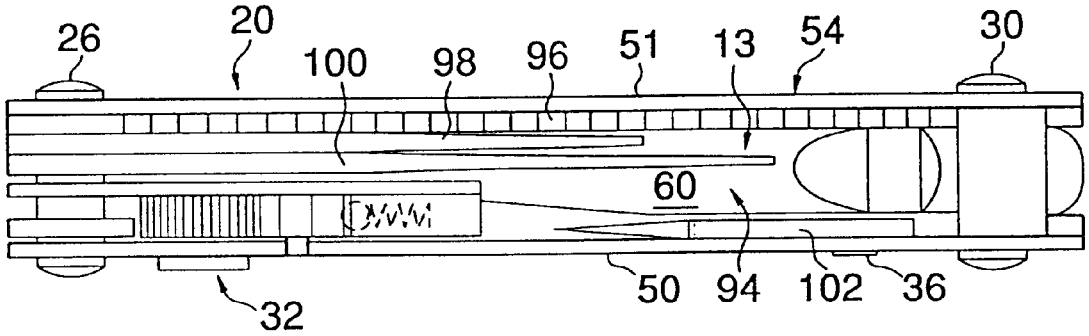
FIG. 10 is a side elevational view of the tool of the present invention in a folded configuration.

A variety of tools may be provided in handles 20, 22, as illustrated in FIGS. 10–14. Exterior first side 54 of first handle 20 is shown in FIG. 10. An interior nesting channel 94 is formed between top side 50, bottom side 51 and interior second side 60 of first handle 20. Such tools as a saw 96, file 98, and a long thin screwdriver 100 (to facilitate access to difficult spaces) may be pivotally coupled to first handle 20, within tool channel 94 via pivot axis 26. An additional tool such as a pick or awl 102 may be pivotally connected within channel 94 via additional pivot axle 36. Pick or awl 102 is shown in the extended position in FIG. 12. Ratchet 32 is preferably positioned on first handle 20 and will be discussed in greater detail below.

Figure 11:
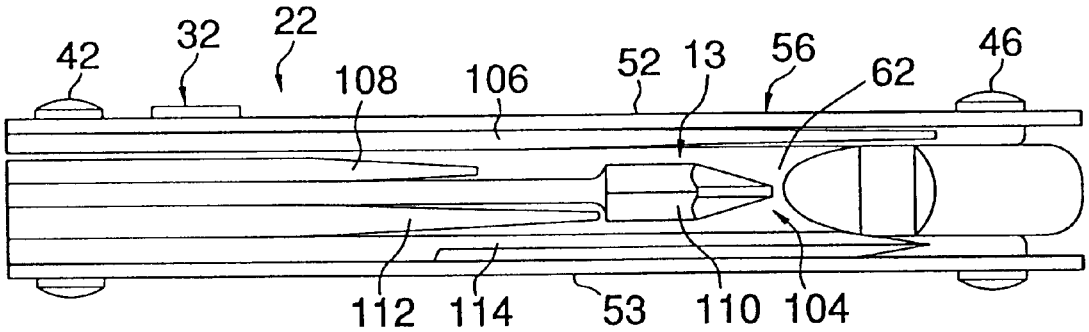
FIG. 11 is a side elevational view of the other side of the tool shown in FIG. 8.
Figure 19:
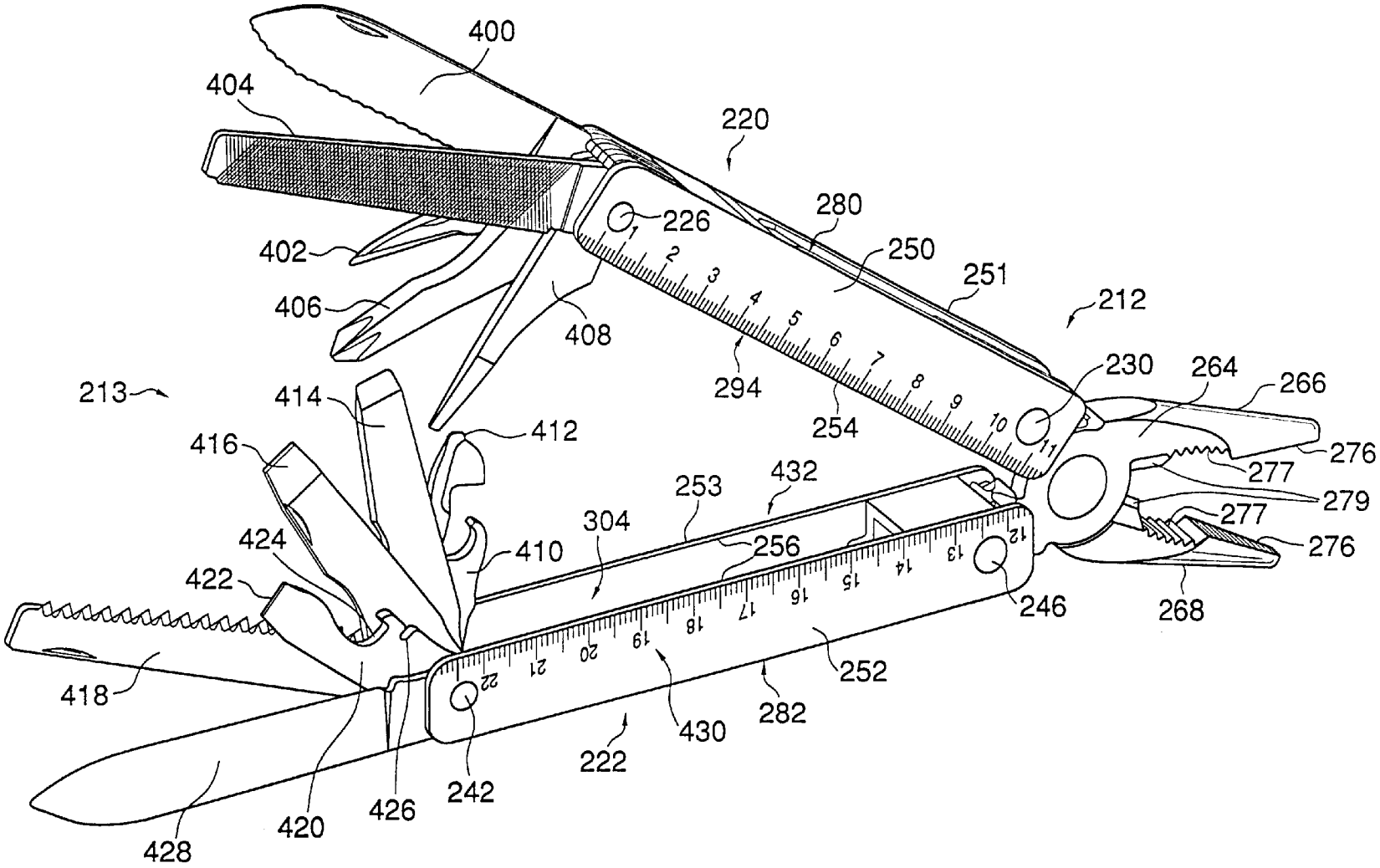
FIG. 19 is a perspective view of a variation of the multiple function tool of FIGS. 1–18.
Figure 20:
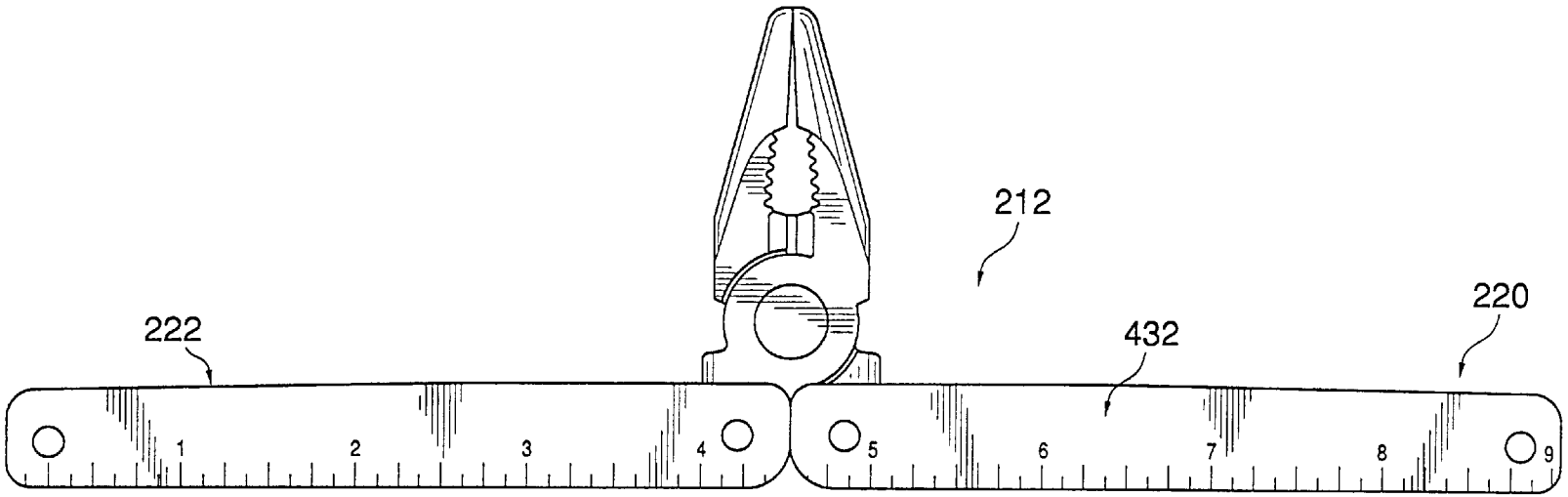
FIG. 20 is an elevational view of the multiple function tool of FIG. 19 in position for use as a ruler.
Figure 21:
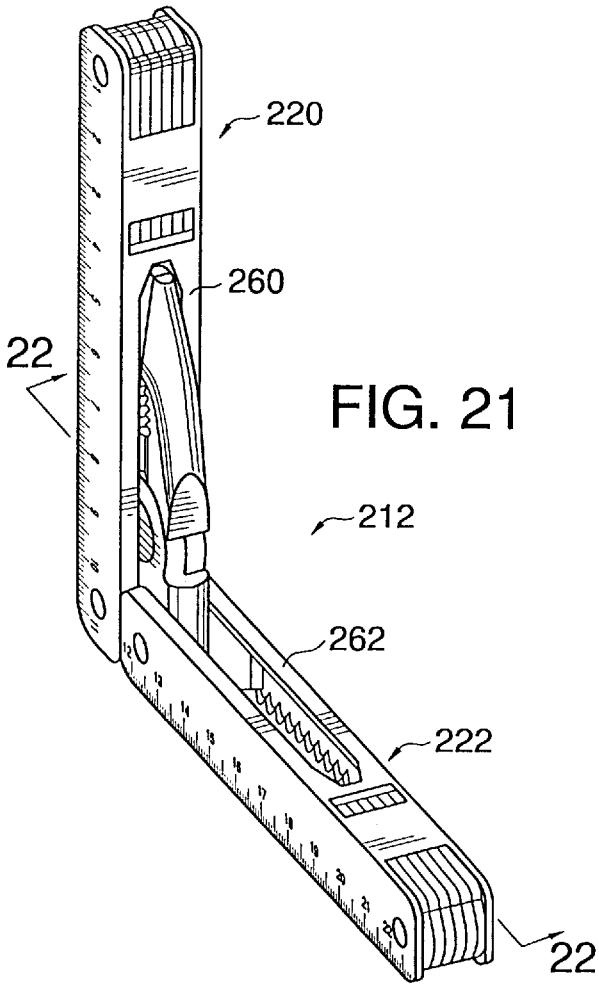
FIG. 21 is a perspective view of the multiple function tool of FIG. 19 in position for use as a right angle with individual blade springs shown.

Additional tools are positioned within tool channel 104 formed in second handle 22, between top side 52, bottom side 53, and interior second side 62, and accessible through first exterior side 56 as shown in FIG. 11. Exemplary tools include a cutting blade 106, a can opener 108, a Phillips head screwdriver 110, a cap lifter/screwdriver 112, and a scissors 114 pivotally connected within tool channel 104 via pivot axis 42. It will be understood that various modifications to the tools 13 shown in the Figs. may be made, such as to the length or width/diameter of the shanks of the tools. It will be further understood that tools different from or in addition to or in different positions from the ones shown may be provided in either of tool channels 94 and 104, such as shown in the embodiment of FIGS. 19–21 described in further detail below. Accordingly, pivot axes 26, 42 may be removed by the user with an appropriate tool in order to replace, change, or reposition the tools or blades.

Figure 12:
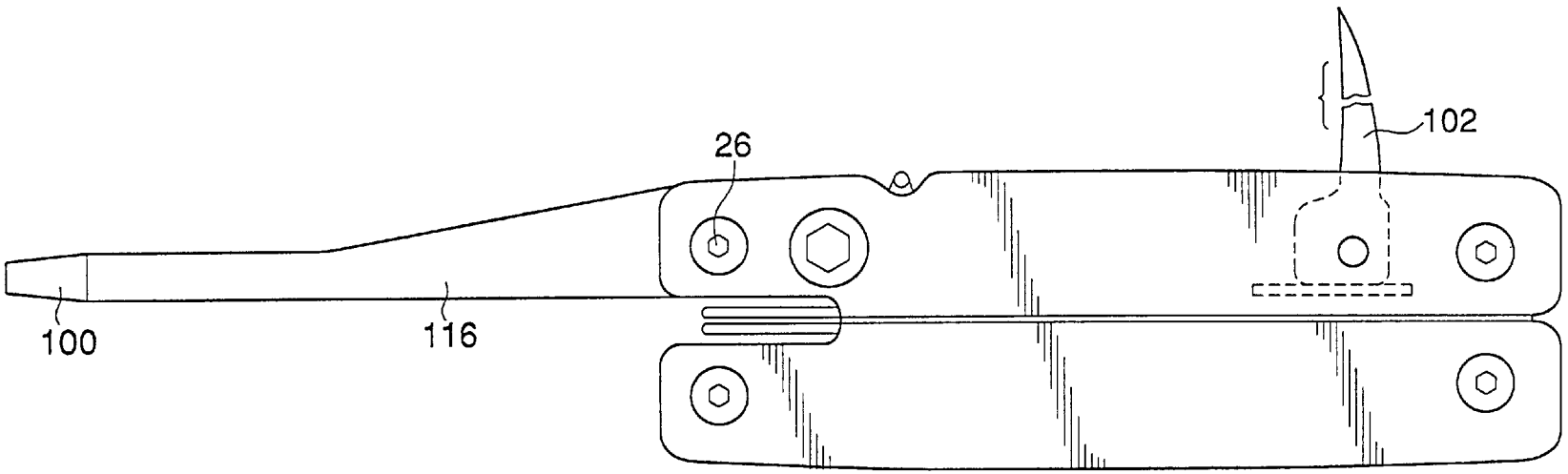
FIG. 12 is a top elevational view of the tool of the present invention in a folded configuration, but with first and second tools in extended positions.
Figure 13:
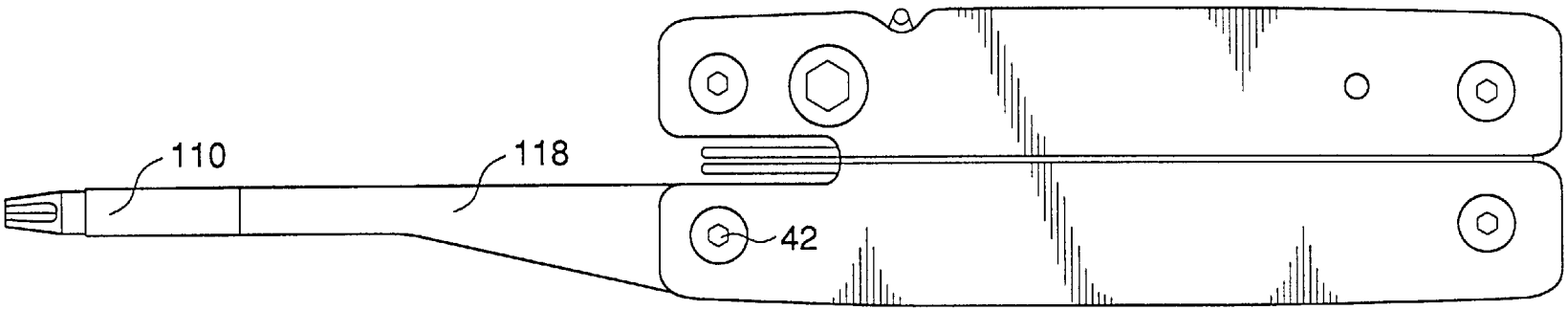
FIG. 13 is a view similar to that of FIG. 12, but with another tool in an extended position.

In accordance with the principles of the present invention, the tools that are pivotally connected to handles 20, 22 within tool channels 94, 104 are preferably shaped to provide optimal usage when extended into a working position. Specifically, as shown in FIGS. 12 and 13, respective shanks 116, 118 of screwdrivers 100, 110 are angled s,such that the heads of the screwdrivers are positioned as close to the interior of the handle formed by handles 20, 22, i.e., the heads of screwdrivers 100, 110 are as close to interior sides 60, 62 as possible and therefore as close to the longitudinal axis of the handles, when held together, as described above. Thus, any force applied to screwdrivers 100, 110 via the handles 20, 22 is transmitted substantially directly to the tool head with as little moment arm, and thus as little loss of applied force, as possible. The same is preferably true for the other tools 13.

Figure 14:
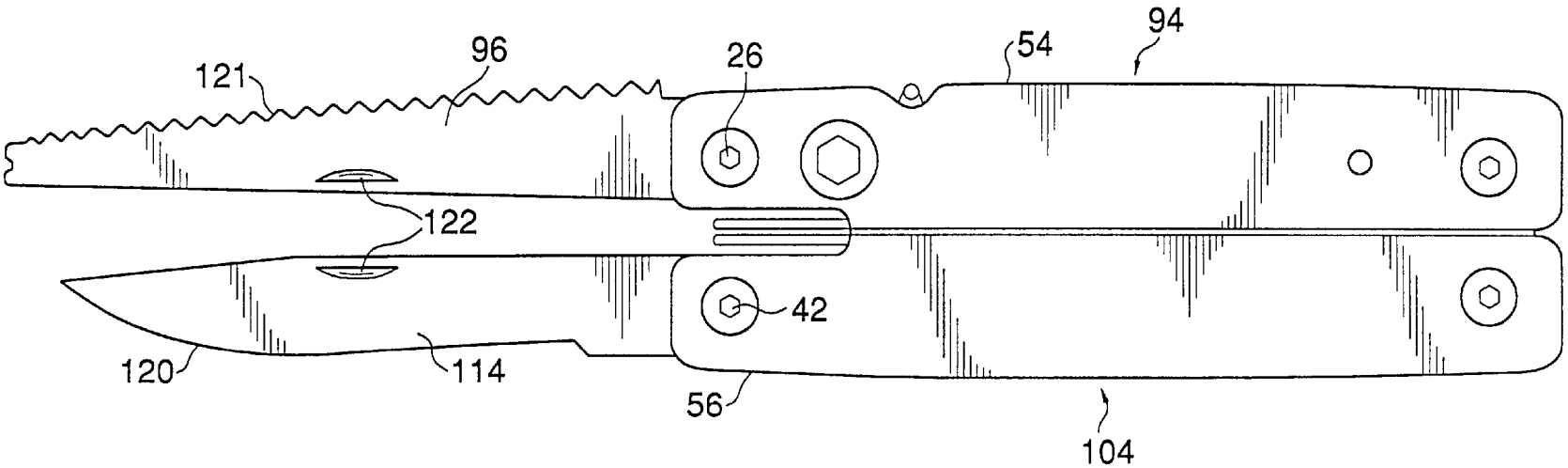
FIG. 14 is a view similar to that of FIG. 12, but with yet other tools in an extended position.

Exemplary blade 114 and exemplary saw 96 are shown in extended positions in FIG. 14. The cutting tools of the multi-tool 12 are also positioned and connected to handles 20, 22 for optimal use in the extended position. Thus, blade edge 120 is positioned as close to exterior first side 56 as possible to facilitate cutting with slicing type blade 114. Likewise, serrated edge 121 of saw 96 is positioned as close to exterior first side 54 as possible to facilitate sawing with saw 96. A notch or groove 122 is provided to assist a user in grasping blade 114 or saw 96 from within tool channel 104, 94 to position blade 114 or saw 96 in the extended, usable position shown in FIG. 12. It will be understood that other tools of multi-tool 14 may include similar notches 122.

Figure 15:
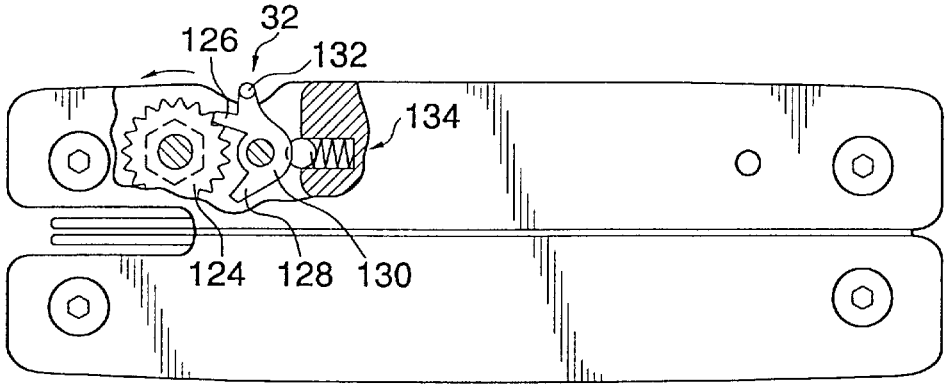
FIG. 15 is a top elevational view of the tool of the present invention in a folded configuration, but with partially cutaway portions showing the internal mechanism of the ratchet of the tool, the ratchet being in a first operative position.
Figure 16:
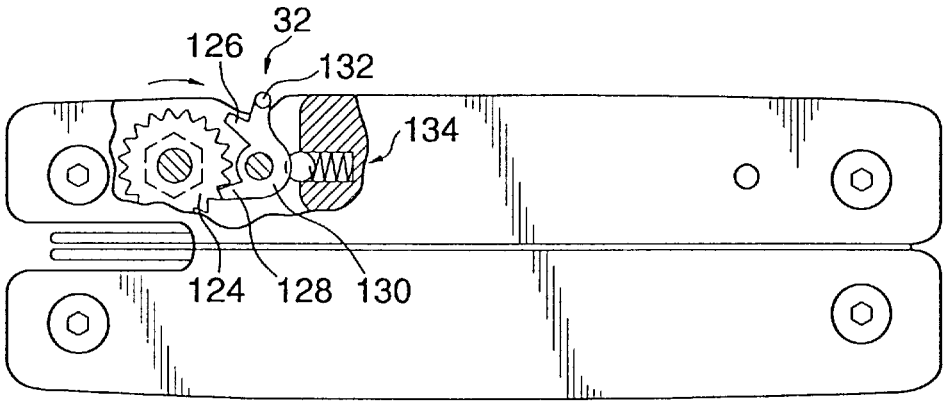
FIG. 16 is a view similar to that of FIG. 15, but with the ratchet in a second operative position.
Figure 18:
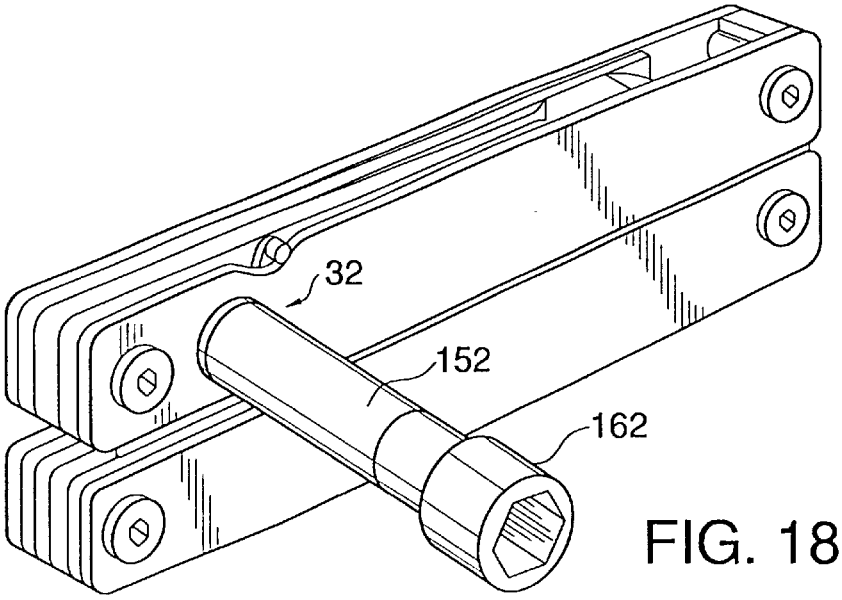
FIG. 18 is a perspective view of the tool of the present invention in a folded configuration, and with an adapter positioned within the ratchet and a hex socket in position for use on the adapter.

Multi-tool 12 may be provided with a mechanical reversing ratchet 32, positioned within first handle 20. The internal mechanism of ratchet 32 is shown in FIGS. 15 and 16. Ratchet 32 includes a ratchet wheel 124 alternately engaged by one of pawls 126, 128, which pawls are disposed on lever 130. Lever 130 includes a lever switch 132 for selecting which of pawls 126, 128 is to engage ratchet wheel 124. A biasing member or unit 134, such as a spring and ball, or leaf spring, or other detente device, is provided to maintain the selected pawl 126, 128 in its engaged position with ratchet wheel 124. When pawl 126 is engaged with ratchet wheel 124, as shown in FIG. 15, ratchet 32 is usable only in the counterclockwise position. Pawl 126 is shaped to prevent clockwise rotation of ratchet wheel 124. As shown in FIG. 16, when pawl 128 is engaged with ratchet wheel 124, ratchet 32 moves only in the clockwise position. Pawl 128 is likewise shaped to prevent rotation of ratchet wheel 124 in the opposite direction, in this case, counterclockwise rotation.

Figure 17:
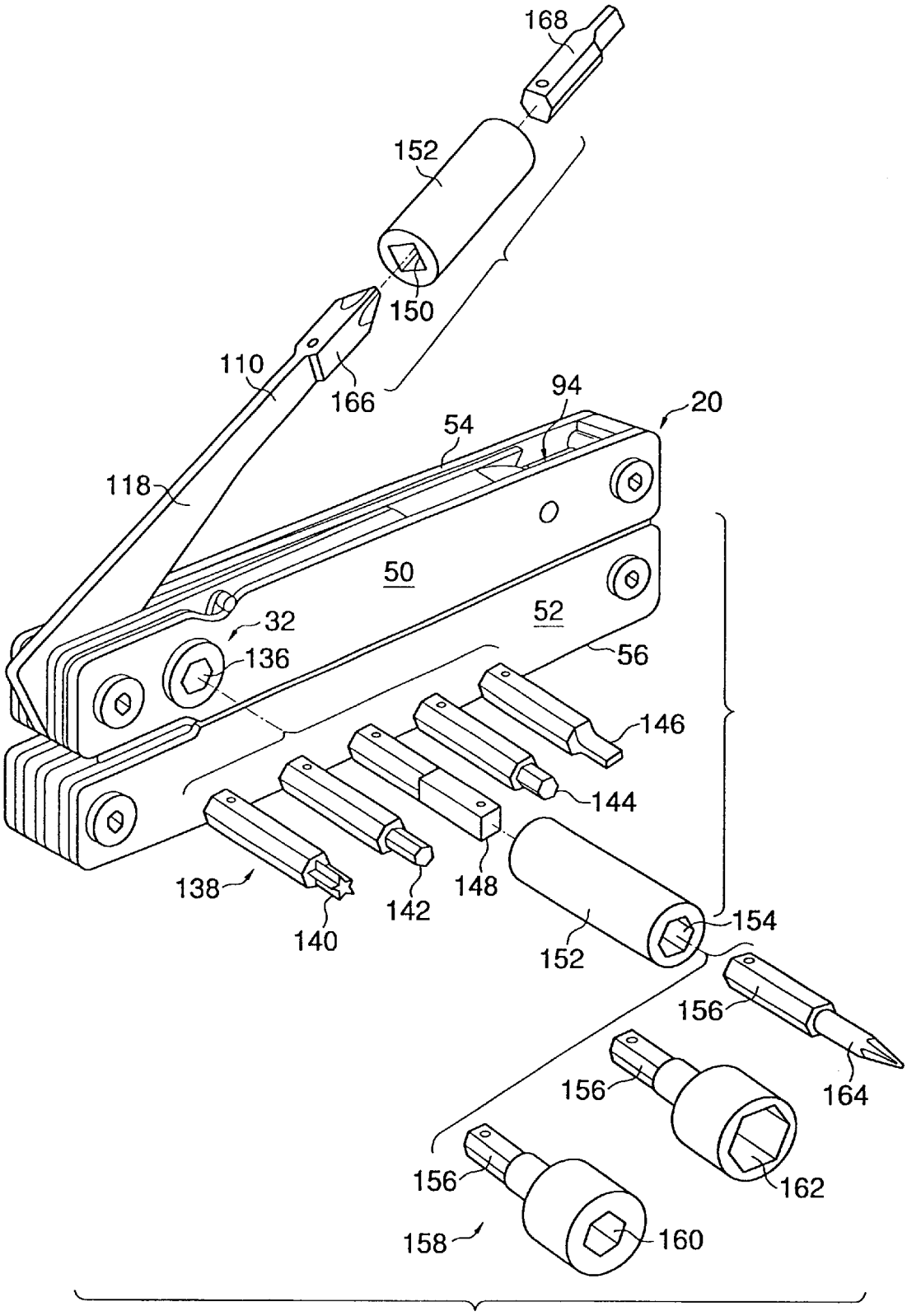
FIG. 17 is a perspective view of the tool of the present invention, showing various adapters and additional tool heads that may be used with the tool of the present invention.

Referring now to FIG. 17, ratchet 32 is preferably provided with a socket 136 shaped to fit a variety of tool heads 138. Exemplary tool heads 138 include a variety of tips, such as a star-shaped tip 140, a hex tip 142, a square-shaped tip 148, another sized hex tip 144 and a screwdriver tip 146. Square-shaped tip 148 may function as an adapter that fits into socket 150 of adapter 152. Adapter 152 includes an additional adapter socket 154 in which shanks 156 of additional tool heads 158 may fit. Adapter 152 may be magnetic, if desired, to provide a more secure coupling. Adapter 152 is thus provided to permit tool heads 158 to extend the length of the tools that are pivotally coupled to multi-tool 12. Tool heads 158 may include a variety of different sized sockets 160, 162 for use as socket wrenches, and phillips screwdriver 164. An exemplary socket 162 is shown connected to ratchet 32 via adapter 152 and 148 in FIG. 18.

Phillips screwdriver 110 that is pivotally connected within tool channel 94 of first handle 20 is preferably provided with a substantially square distal portion 166 of shank 118 that may be fit within square socket 150 of adapter 152 (FIG. 17). Accordingly, different tool heads, such as screwdriver tool head 168, may be positioned on shank 118 to provide a non-ratcheting tool different from the ones that are pivotally connected to and form an integral part of multi-tool 12. Moreover, adapter 152 may thus function as an extender to thereby provide longer tools for accessing difficult to reach areas.

Tools and tips that are smaller and larger than adapter 154 may also be provided either with adapter set 14 or as an optional accessory pack. The distal portions of others of tools 13 may similarly have a square cross-section. Tool heads 138, 156 and adapter 152 may be stored on adapter set 14 and can be fit, together with multi-tool 12, within case 16, as shown in FIGS. 1 and 2.

As described above, multi-tool 12 may be provided with additional or alternative tools, such as multi-tool 212 of FIGS. 19–21. Elements of multi-tool 212 that correspond to elements of multi-tool 12 are labeled with reference numerals used with respect to multi-tool 12 increased by 200. Multi-tool 212 includes tool head 264, preferably in the form of pliers, pivotally coupled to respective handles 220, 222 via respective pivot axes 230, 246. Tool head 264 preferably includes wire cutter 279 in addition to gripping surfaces 276, 277. As in multi-tool 12, multi-tool 212 is foldable into a compact configuration similar to the configuration of multi-tool 12 shown in FIG. 3. Upon folding multi-tool 212 into a compact configuration, jaw members 266, 268 of tool head 264 are nested within tool head channels 280, 282 of respective handles 220, 222. Jaw pockets such as those provided in multi-tool 12 may also provided in multi-tool 212.

Once multi-tool 212 is folded such that tool head 264 is in a stored position, the additional tools 213, stored in channels 294, 304, are readily accessible. Such additional tools as serrated blade 400, reamer and punch 402, metal saw and metal file 404, phillips head screwdriver 406, and screwdriver 408 (preferably a small sized screwdriver, e.g., approximately 2 mm) may be pivotally connected to handle 220 via pivot axis 226 and storable within channel 294. Such additional tools as combination screwdriver can opener 410 (having screwdriver edge 412 preferably approximately 3 mm long), chisel/scraper 414, large sized screwdriver 416 (preferably approximately 7 mm), wood saw 418; combination tool 420 having a medium sized screwdriver head 422 (preferably approximately 5 mm), a cap lifter 424, and a wire stripper 426; and a large blade 428 may be pivotally connected to handle 222 via pivot axis 242 and storable within channel 304. Pivot axes 226 and 242 may be removed by the user with an appropriate tool in order to replace, change, or reposition the tools or blades. It will be understood that additional tools, such as scissors, a lanyard loop, a fish scaler or a corkscrew, may be provided instead or in addition to the tools shown. Additionally, handle 222 may be provided with a ratchet similar to ratchet 32 of multi-tool 12, with similar attachments as described with reference to the above-described multi-tool 12 embodiment.

In addition to tools 213, multi-tool 212 may also be provided with a metric ruler 430 on top surfaces 250, 252 of handles 220, 222, and a full length (e.g. 12 inches) English ruler 432 on bottom surfaces 251, 253. Preferably, the marks of the rulers 430, 432 are adjacent first sides 254, 256. Accordingly, as mentioned above, when rulers are provided on handles 220, 222, preferably straight edges are also provided (by forming first sides 254, 256 straight, rather than bowed) such that rulers 430, 432 may be read right up to the edges to facilitate accurate reading of the side of the measured item). As shown in FIG. 20, handles 220, 222 may be extended to be substantially collinear such that the full extent of ruler 432 may be used. Alternatively, handles 220, 222 may be positioned at right angles, such as shown in FIG. 21, to provide a right angle with multi-tool 212 for measurement or other purposes.

Figure 24:
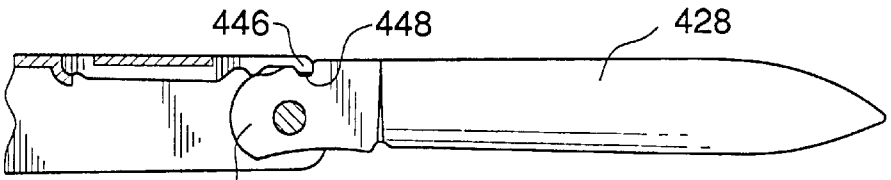
FIG. 24 is an isolated cross-sectional view similar to that of FIG. 23, but with the tool fully withdrawn into a usable position.
Figure 24A:
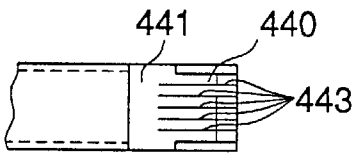
FIG. 24A is an elevational view of a handle of the multiple function tool shown in FIG. 24, but with a side removed to reveal the formation of spring elements therein.
Figure 23:
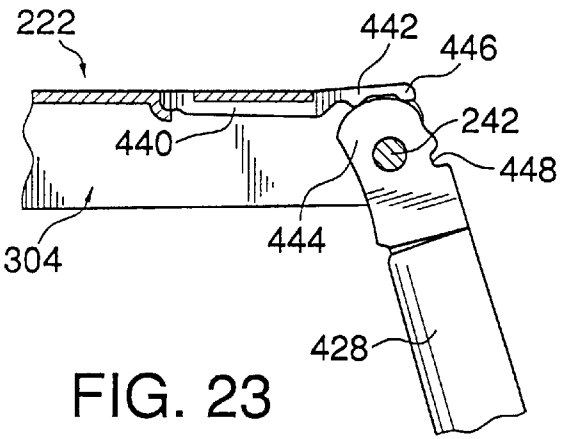
FIG. 23 is an isolated cross-sectional view of a handle of the multiple function tool of FIG. 21 showing a tool partially withdrawn from a storage position and the action of individual blade springs.
Figure 22:
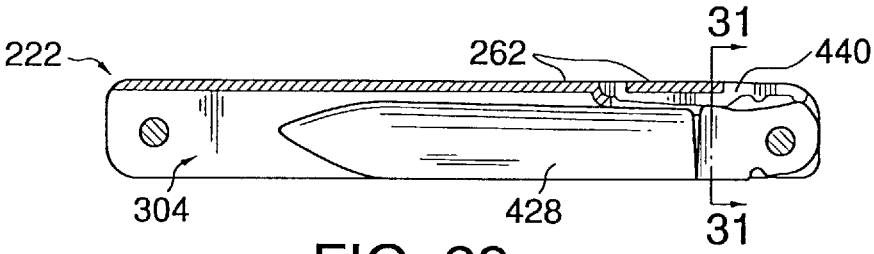
FIG. 22 is a cross-sectional view, along line 22—22 of FIG. 21, of one of the handles of the multiple function tool of FIG. 21.

Another feature of multi-tool 212 that facilitates use of additional tools 213 (in addition to the position of the tools 213 for removal from the first sides 254, 256 when multi-tool 212 is in the compact, folded configuration) is the provision of an individual spring for each individual tool. An individual spring 440 associated with exemplary blade 428 is shown in FIGS. 22–24, FIG. 22 being a cross-section along line 22—22 in FIG. 21 of handle 222. It will be understood that the description of spring 440 may be applied to any of tools 213. Blade 428 is in nested position within channel 304 of handle 222 as shown in FIG. 22. Upon withdrawal of blade 428 from within channel 304, resilient end 442 of spring 440 (adjacent pivot end 444 of blade 428, which is pivotally connected to handle 222 via pivot axis 242) flexes outwardly as shown in FIG. 23. The free end of resilient end 442 of spring 440 is provided with tooth 446 and pivot end 444 of blade 428 is provided with a notch 448 for receiving tooth 446 when blade 428 is in the fully extended position shown in FIG. 24. Thus, blade 428 is prevented from further rotation away from channel 304, such that application of force to blade 428 during cutting, slicing, etc., is transmitted to the blade to perform the desire task without causing further rotation of blade 428. The radius of curvature of first end 444 is selected to provide sufficient resistance to opening, yet does not unduly restrict opening. If desired, the radius of curvature may vary to produce a desired change. in resistance to opening/closing. Although, springs 440 may be formed as separate elements, it is simpler to manufacture springs 440 from a single plate 441 having a plurality of cuts 443 separating plate 441 into springs 440. (See FIG. 24A).

Figure 26:
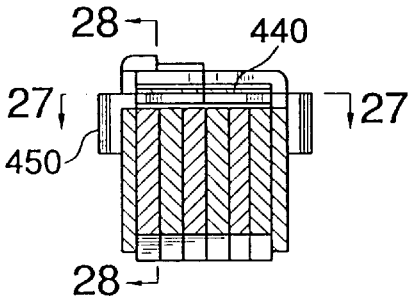
FIG. 26 is a cross-sectional view, along line 26—26 of FIG. 25, of a handle of the multiple function tool of FIG. 25.
Figure 27:
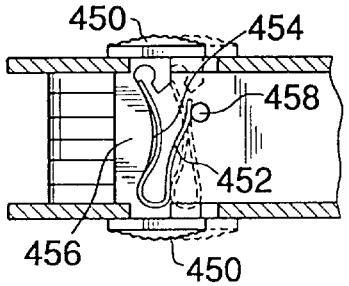
FIG. 27 is a cross-sectional view along line 27—27 of FIG. 26, showing the functioning of the spring lock mechanism.

A further modification to the spring feature shown in FIGS. 22–24 is the provision of a spring lock 450 on multi-tool 212', as shown in FIGS. 25–30. Spring lock 450 may be used with springs essentially the same as spring 440 of FIGS. 22–24. Accordingly, the spring in FIGS. 25–30 is labeled as spring 440 with tooth 446 at its resilient end 442. It will be understood that spring lock 450 may be applied to a spring 440 of any of the tools of the multi-tool, reference being made herein to only blade 428 for the sake of simplicity. As may be seen in FIG. 26, which is a cross-sectional view along line 26—26 of FIG. 25, spring lock 450 is positioned below spring 440, for reasons as will be understood with reference to FIGS. 28–30. Spring lock 450 is biased by a biasing spring 452 fitted against curved end 454 of spring lock plate 456 of spring lock 450 and post 458, as shown in FIG. 27, which Fig. is a cross-sectional view along line 27—27 of FIG. 26. Biasing spring 452 is illustrated in FIG. 27 in an extended position in solid lines to bias spring lock plate 456 to the left against an end of an extended tool, as will be described in further detail below. Post 458 provides a surface, which is fixed with respect to the handle, against which biasing spring 452 may be biased upon moving spring lock plate 456 to the right, as shown in phantom in FIG. 27, and as will be described in further detail below. Biasing spring 452 may be a leaf spring, as shown, or any other spring that would provide the desired biasing effect.

Figure 28:
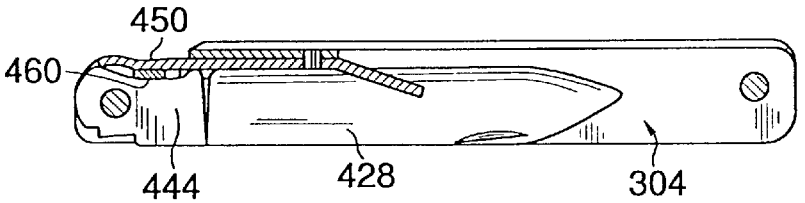
FIG. 28 is a cross-sectional view along line 28—28 of FIG. 26, showing a tool in a storage position and the spring lock mechanism in a neutral position.
Figure 29:
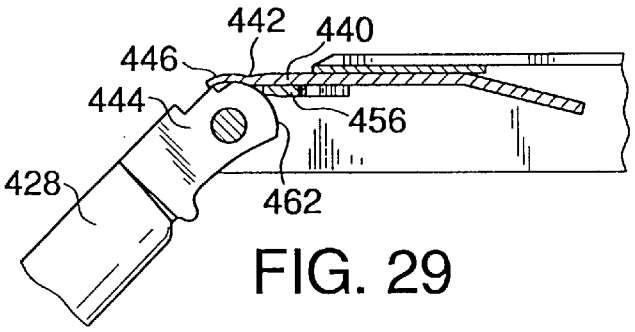
FIG. 29 is an isolated cross-sectional view similar to that of FIG. 28, but showing a tool partially withdrawn from a storage position.
Figure 30:
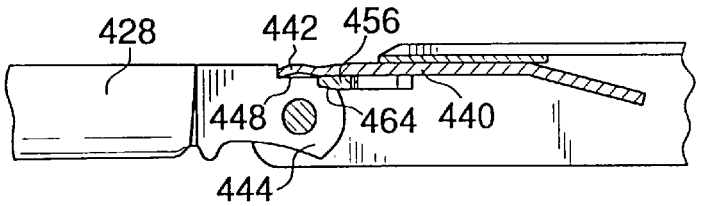
FIG. 30 is an isolated cross-sectional view similar to that of FIG. 29, but showing the tool in a completely withdrawn and locked position.

As may be seen in FIG. 28, which shows a cross-sectional view along line 28—28 of FIG. 26, pivot end 444 of blade 428 is provided with a partially cut away area 460 that accommodates spring lock 450 when blade 428 is nested within channel 304 such that spring lock 450 is in an essentially neutral position. As blade 428 is withdrawn from channel 304, as in FIG. 29, curved end 462 of pivot end 444 rides along spring lock 450, pushing spring lock plate 456 to the right, against biasing spring 452. Once blade 428 is fully withdrawn, as shown in FIG. 30, spring lock 450 returns to an essentially neutral position as spring lock plate 456 comes to rest in notch 464 of pivot end 444. In the fully withdrawn position, notch 464 and spring lock 450 prevent rotation of blade 428 back into channel 304 without first moving spring lock 450 out of the way, i.e., to the right, against biasing spring 452. Thus, an inadvertent closure of blade 428 is prevented. As in the embodiment of FIGS. 22–24, pivot end 444 is also provided with a notch 448 in which resilient end 442 of spring 440 rests when blade 428 is fully extended. Resilient end 442 and notch 448 prevent further rotation of blade 428 out of channel 304 so that force applied to blade 428 may be transmitted to the workpiece. Blade 428 can now only be retracted into channel 304 by first moving spring lock 450 and spring plate 456 to the right, against biasing spring 452, and thus out of notch 464 and thereafter pivoting blade 428 into channel 304. Curved end 462 can thus slide along spring lock plate 456, as shown in FIG. 29, and blade 428 may be returned to its nested position within channel 304.

The handles of the multi-tool of the present invention may be formed by any desired process, such as extrusion, or molding, or stampings, and out of any desired material, such as plastic or stainless steel. The front and back surfaces of the handles may further be textured and the above-described rulers may be formed in the basic structural material of the multi-tool or from separate aluminum or plastic pieces coupled to the handles in any desired manner. Upon comparison of multi-tool 212 of FIG. 21 and multi-tool 212' of FIG. 26, it may be seen that the handles of the multi-tool of the present invention may be formed as either a one-piece unit or a two-piece unit, as will now be described. It will be understood that the description of the handles of these embodiments is also applicable to multi-tool 12.

Figure 31:
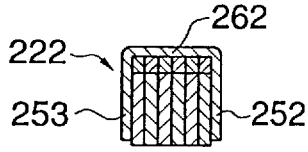
FIG. 31 is a cross-sectional view, along line 31—31 of FIG. 22, of a one-piece handle of a multiple function tool of the present invention.

Handles 220, 222 of multi-tool 212 shown in FIG. 21 are formed essentially as a one-piece unit. A cross-section of handle 222, along line 31—31 of FIG. 22, illustrating the formation of handle 222 as a one-piece unit is shown in FIG. 31. As may be seen in FIG. 31, top surface 252, second side 262, and bottom surface 253 form a substantially one-piece handle 222.

Figure 33:
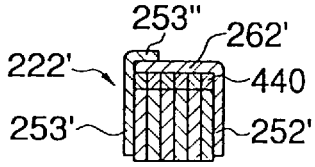
FIG. 33 is a cross-sectional view, along line 33—33 of FIG. 32, of a two-piece handle of a multiple function tool of the present invention.
Figure 32:
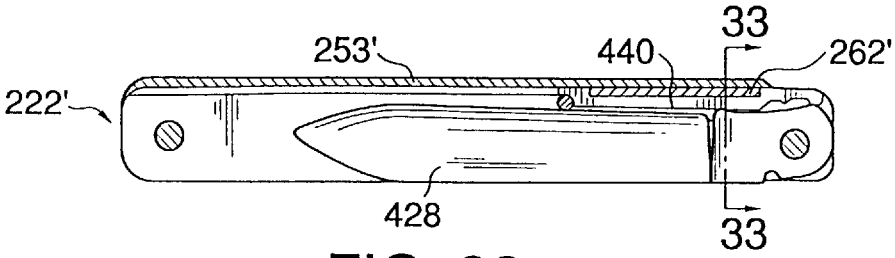
FIG. 32 is a view similar to that of FIG. 22, but showing a two-piece handle.
Figure 25:
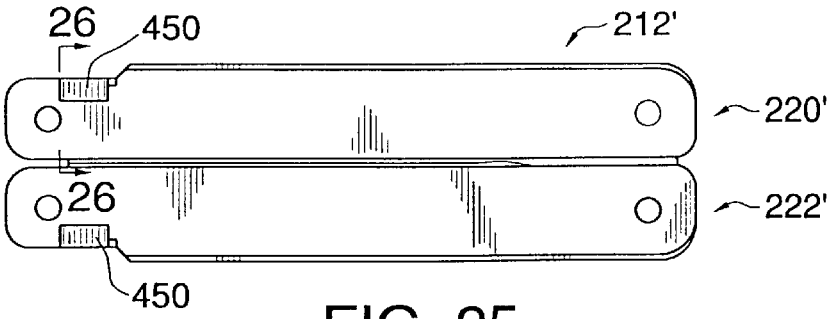
FIG. 25 is a front elevational view of a multiple function tool in accordance with the principles of the present invention having a spring lock mechanism.

Alternatively, handles 220', 222' may be formed from two overlapping pieces, as shown in FIGS. 26, 32, and 33. As may be seen upon comparing FIG. 32 with FIG. 22, which essentially are the same cross-sectional view through one of the handles of a multi-tool of the present invention, second side 262' of two-piece handle 222' is formed as an overlap of a portion of bottom surface 253' and second side 262', whereas second side 262 of handle 222 is substantially uniform. The overlap of second side 262' of handle 222' may be seen, more easily, in FIG. 33. Bottom surface 253' has a bent edge 253' that overlaps second side 262' and facilitates bonding of the two halves of handle 222'. Preferably, second side 262' is closest to springs 440, as shown, to provide support for springs 440.

From the foregoing description, it will be clear that the present invention may be embodied in other specific forms, structures, arrangements, proportion, and with other elements, materials, and components, without departing from the spirit or essential characteristics thereof. One skilled in the art will appreciate many modifications of structure, arrangement, proportions, materials, and components, and otherwise, use in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims, and not limited to the foregoing description.

What is claimed is:

1. A multiple function tool comprising:

a first handle having first and second opposing sides;

more than one tool coupled to said first handle for movement along a pivot plane between a storage position and an extended working position; and a first locking mechanism positioned along one of said opposing sides of said first handle and positioned with respect to said tools such that each of said tools is separately lockable by said first locking mechanism into an extended working position;

wherein said first locking mechanism is positioned with respect to said first handle to permit actuation thereof to release a tool from being locked in an extended working position without the user crossing said pivot plane.

2. A multiple function tool as in claim 1, further comprising a second handle coupled to said first handle and having first and second sides, wherein:

more than one tool is coupled to said second handle for movement along a pivot plane between a storage position and an extended working position;

a second locking mechanism is coupled to said second handle and positioned with respect to said tools such that each of said tools coupled to said second handle is lockable by said second locking mechanism into an extended working position;

said second locking mechanism is positioned with respect to said second handle to permit actuation thereof to release a tool in an extended working position and to return the tool to a storage position without the user crossing said pivot plane; and a portion of at least one of said first and second locking mechanisms is accessible along one of the first and second sides of the handle to which said locking mechanism is coupled for actuation such that a user's finger need not pass through said pivot plane to actuate said locking mechanism to release a tool from being locked in an extended working position.

3. A multiple function tool as in claim 2, wherein:

said first handle has a channel formed therein in which said tools coupled to said first handle are positioned when in a storage position;

said second handle has a channel formed therein in which said tools coupled to said second handle are positioned when in a storage position; and said first and second locking mechanisms and said tools are positioned to be accessible when said first and second handles are in a folded configuration.

4. A multiple function tool as in claim 1, wherein said locking mechanism comprises a spring lock plate having a major plane perpendicular to said pivot plane.

5. A multiple function tool comprising:

a first handle having a longitudinal axis and a channel wall defining a channel;

more than one tool coupled to said first handle for movement along a pivot plane between a storage position and an extended working position; and a locking mechanism slidably coupled to said first handle for movement along said longitudinal axis between (a) a locking position in which said locking mechanism is sandwiched between said tools and said channel wall to contact and to lock any of said tools into an extended working position, and (b) an unlock position in which said tools are free to move between said storage position and said extended working position;

wherein each tool is positioned with respect to said locking mechanism to be locked by said locking mechanism.

6. A multiple function tool as in claim 5, wherein said locking mechanism is slidable along said longitudinal axis into and out of direct contact with a selected tool to selectively lock said selected tool into one of said storage position and said extended working position.

7. A multiple function tool as in claim 5, wherein said locking mechanism selectively prevents a selected tool from moving from an extended working position into a storage position.

8. A multiple function tool comprising:

a first handle;

a plurality of tools each pivotably coupled to said first handle for movement along a pivot plane between a storage position and an extended working position; and a locking mechanism comprising a flat spring lock plate lying perpendicular to said pivot plane and slidably coupled to said handle for selectively locking any of said plurality of tools into a working position;

wherein each tool is positioned with respect to said locking mechanism to be locked by said locking mechanism while any number of said plurality of tools remains in said storage position.

9. A multiple function tool as in claim 8, wherein said first handle has a longitudinal axis and said locking mechanism is slidably coupled to said handle for movement along said longitudinal axis.

10. A multiple function tool as in claim 8, further comprising a plurality of springs coupled to said handle and corresponding to said plurality of tools, said locking mechanism being movable with respect to said springs.

11. A multiple function tool as in claim 8, wherein said locking mechanism is positioned to directly contact said selected tool to selectively lock said selected tool in a working position.

12. A multiple function tool as in claim 11, wherein:

each of said tools has a pivot end by which said tool is coupled to said handle;

a locking notch is defined in said pivot end of each said tool; and said locking mechanism selectively slides into and out of engagement with said locking notch in said pivot end to selectively prevent movement of said tools from said extended working position into said storage position.

13. A multiple function tool as in claim 8, wherein:

said first handle has first and second sides; and said locking mechanism is positioned along one of said sides of said first handle.

14. A multiple function tool as in claim 8, wherein:

said plurality of tools are coupled to said first handle for movement along a pivot plane between said storage position and said extended working position; and said locking mechanism is positioned with respect to said first handle to permit actuation thereof to release a tool in an extended working position and to return the tool to a storage position without the user crossing said pivot plane.

15. A multiple function tool as in claim 8, further comprising:

a second handle coupled to said first handle and having first and second sides; and a tool head having first and second jaw members coupled to each other, said first jaw further being coupled to said first handle and said second jaw further being coupled to said second handles.

16. A multiple function tool as in claim 8, wherein:

said first handle has a longitudinal axis and a channel wall defining a channel; and said locking mechanism is coupled to said first handle for movement between a locking position, in which said locking mechanism is positioned between said plurality of tools and said channel wall to contact and to lock any of said tools into an extended working position, and an unlock position in which said plurality of tools are free to move between said storage position and said extended working position.

17. A multiple function tool as in claim 5, wherein said locking mechanism is directly adjacent said channel wall.

18. A multiple function tool comprising:

a first handle having first and second sides and a longitudinal axis;

more than one tool pivotably coupled to said first handle for movement along a pivot plane between a storage position and an extended working position; and a first locking mechanism coupled to said first handle and positioned with respect to said tools to lock any one of said tools into an extended working position;

wherein:

said locking mechanism is in a neutral position when said tools are in said storage position;

said locking mechanism is movable from said neutral position along said handle longitudinal axis as a tool is withdrawn from said storage position and into said extended working position; and once said tool is fully withdrawn into said extended working position, said locking mechanism returns to said neutral position.

* * * * *